US007021468B2

(12) United States Patent
Cargile, Jr.

(10) Patent No.: US 7,021,468 B2
(45) Date of Patent: Apr. 4, 2006

(54) SHIPPING AND DISPLAY CARTON

(75) Inventor: John W. Cargile, Jr., Decatur, GA (US)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 364 days.

(21) Appl. No.: 10/393,739

(22) Filed: Mar. 21, 2003

(65) Prior Publication Data

US 2004/0099570 A1 May 27, 2004

Related U.S. Application Data

(60) Provisional application No. 60/366,856, filed on Mar. 22, 2002.

(51) Int. Cl.
*B65D 1/22* (2006.01)

(52) U.S. Cl. ..... 206/746

(58) Field of Classification Search ..... 206/264, 206/271, 273, 297, 299, 432, 499, 746, 750, 206/784

See application file for complete search history.

(56) References Cited

U.S. PATENT DOCUMENTS 2,020,876 A * 11/1935 Clark et al. ..... 206/746
2,111,621 A 3/1938 Gerking et al.
2,197,510 A 4/1940 Ringler
2,315,999 A * 4/1943 Holm ..... 206/750
2,316,186 A 4/1943 Powell
2,418,526 A 4/1947 Reitman
2,888,132 A 5/1959 Guyer
3,139,979 A * 7/1964 Russell ..... 206/746
3,474,949 A 10/1969 Shine
3,580,482 A 5/1971 Witte
3,618,758 A * 11/1971 Shaw et al. ..... 206/436
3,650,394 A 3/1972 De Cazenove
3,653,495 A * 4/1972 Gray ..... 206/746
3,693,788 A 9/1972 Oglesbee
3,884,348 A * 5/1975 Ross ..... 206/746
4,582,194 A * 4/1986 Karpiloff et al. ..... 206/485
5,857,570 A 1/1999 Brown
5,921,398 A 7/1999 Carroll
5,927,498 A 7/1999 Saam
D419,440 S 1/2000 Hansen
6,129,211 A 10/2000 Prakken et al.

* cited by examiner

*Primary Examiner*—Kurt Fernstrom
(74) *Attorney, Agent, or Firm*—Tsugihiko Suzuki

(57) ABSTRACT

The carton is convertible into two display trays on which tapered articles may be displayed. The trays can be pivoted about a fold line without disturbing each row of articles in the carton. The fold line is formed in the base of the carton whereas lines of weakening are formed in the top, front and rear. The top of the carton is provided with a pair of parallel weakened or tear lines that are parallel to the fold line in the base. The tear lines in the top extend all the way across the top to define between themselves a removable portion. The distance between the fold line and either tear line of the top is dimensioned such that the two rows of articles may be efficiently separated or uninterleaved from each other while held respectively in the two trays when the two trays are pivoted about the fold line.

21 Claims, 8 Drawing Sheets

SHIPPING AND DISPLAY CARTON

This application claims the benefit of Provisional Application No. 60/366,856 filed Mar. 22, 2002.

BACKGROUND OF THE INVENTION

The present invention relates generally to a carton for the storage, shipping and display of articles, and more particularly, to a carton which is convertible from a substantially closed form to an opened form for displaying articles, especially articles in the form of tapered primary containers, such as stand-up pouches. The carton of this invention is formed with weakened lines or tear lines for facilitating the carton being opened and divided into two sections connected along a fold line. The two sections of the carton are then pivoted to a position alongside of each other to expose the articles in a manner to effectively display the articles.

Pouches are used for packaging a variety of products in liquid or in dry form. A typical stand-up pouch has a generally flat bottom to support the pouch in its stand-up position and is tapered to the top. At the top, the front and rear walls of the pouch are in adjacent, sealed relationship to each other. As viewed from the side, such pouches have a generally triangular configuration with a thin top and a thick bottom but as viewed from the front, the bottom is narrower than the top.

Because of the irregular configuration of a pouch discussed above, packaging a quantity of pouches for shipment or the display of multiple pouches has always been a problem. For example, various forms of chipboard trays may be loaded with the stand-up pouches and then placed within a further shipping carton. This arrangement, due to the irregular shape of the pouches, resulted in larger shipping cartons which increased the cost for manufacturing since more material was required. To reduce the costs and labor requirements associated with conventional packages used to transport stand-up pouches, shipping and display cartons such as those disclosed in U.S. Pat. No. 5,927,498 to Saam have also been developed. The Saam carton allows two rows of irregularly shaped stand-up pouches to be nested or interleaved during shipping. The Saam carton has weakened lines in the front, top, rear and base such that the carton can be severed into two sections that serve as two display trays on which the pouches are displayed. When separated, the two sections are moved in opposite directions so that the two rows of pouches also separate from each other and move with the display trays respectively. By this means, the two rows of pouches are automatically displayed on the two trays respectively without requiring additional handling. This way of separation, however, would result in two discrete trays that are subject to mutual displacement, which does not always agree with the tidy appearance required of a display device at retail stores. The Saam carton can alternatively provide two connected trays to maintain them in a side-to-side aligned relationship. To provide such connected trays, the weakened line in the base of the carton remains unbroken, and thus the two sections of the carton are required to pivot about the unbroken weakened line to bring the two sections into a side-by-side position. During the pivotal movement, either section of the carton would interfere at its top with the pouches on the other section such that efficient separation of the two rows is hindered. This would result in dislodging of some of the pouches from the display trays during the conversion of the carton into the trays.

Accordingly, there exists a need for a shipping and storage carton or package for tapered articles which may easily be converted into a pair of connected display trays. Such a carton or package should be divided into two sections that can be pivoted about a fold line to allow the two packaged rows of articles to easily separate from each other as the two sections are pivoted.

SUMMARY OF THE INVENTION

The present invention contemplates arranging tapered articles in a two-row group wherein the thin tops of the articles in one row are interleaved between the thin tops of the articles in the other row. The articles are so arranged that the volume occupied by the number of such tapered articles is reduced to a minimum. The tapered articles arranged in this manner are packaged in a carton having a rectilinear configuration so that the bottoms of the articles in the two rows face the opposed side walls of the carton containing the articles.

The invention also contemplates separating the carton or package along lines of weakening to convert the carton into two display trays with the opposed side walls of the original carton forming the respective bottoms of the trays. This arrangement makes it possible to utilize the carton as a display device for the articles at the retail sales outlet.

The present invention further contemplates pivoting the two divided sections of the carton about a fold line without disturbing each row of the packaged articles. The fold line is formed in the base of the carton whereas lines of weakening are formed in the top, front and rear of the carton. The top of the carton is provided with a pair of juxtaposed weakened lines or tear lines that are located generally at an equal distance from the fold line in the base. The tear lines in the top extend all the way across the top to define between themselves a removable portion. The distance between the fold line and either tear line of the top is dimensioned such that the two rows of articles may be efficiently separated or uninterleaved from each other while held in the respective sections of the carton when the two sections are pivoted about the fold line.

Accordingly, the present invention in one aspect provides a package including a carton and a group of tapered articles accommodated in the carton. The carton includes a top wall, front and rear walls extending downwardly from the front and rear edges of the top wall respectively, a base wall extending between the respective lower edges of the front and rear walls, and a pair of opposed side walls extending downwardly from the side edges of the top wall to said base wall. Each article in the group has a top that is less in thickness than its bottom. In the carton, the articles are arranged in two rows that are disposed along the side edges of the top wall respectively. The bottoms of the articles in one row face one of the side walls of the carton whereas the bottoms of the articles in the other row face the other side wall of the carton. The tops of the articles in the one row are disposed in an overlapping nested relationship with the tops of the articles in the other row. The top wall of the carton is formed with a pair of juxtaposed tear lines extending between the front and rear edges of the top wall to define therebetween a first removable portion. The base wall of the carton is formed with a fold line disposed substantially parallel to the tear lines of the top wall. The fold line of the base wall extends between the lower edges of the front and rear walls. Each of the front and rear walls is formed with at least one tear line so that the carton is separable into two display trays with the side walls forming bottoms of said display tray when the removable portion is removed and the base wall is folded double along its fold line. The distance between the fold line of the base wall and either one of the tear lines of the top wall is greater than a maximum distance between the fold line of the base wall and the tops of the articles in either row so that the base wall may be folded about the fold line without causing interference between either one of the display trays and the articles in the other tray.

In a preferred embodiment, the removable portion is disposed mid way between the opposed side edges of the top wall, and the distance along the front edge of the top wall between the tops of the articles in the one row and those of the articles in the other row is less than the distance between the parallel tear lines in the top wall.

In another preferred embodiment, the group of articles are disposed such that the fold line of the base wall extends generally along the thickness of the articles of the group and generally perpendicularly to the length of the articles of the group. The top of each article is greater in width than its bottom while the top and base walls are spaced at a distance generally equal to the width of each article at its top. The carton further comprises a spacer disposed between the top wall and the bottoms of the articles in each row so that the articles in each row are gripped, or otherwise frictionally engaged, at their bottom by the spacers to prevent their dislodging from the respective display tray while the display trays are pivoted or rotated about the fold line to separate the two rows of articles.

The spacers may be formed from the side walls of the carton. Alternatively, each side wall may comprise top and base flaps hingedly connected respectively to the top and base walls, and each spacer may comprise an engaging flap hingedly connected to the base flap of the adjacent side wall. The top flap of each side wall may extend downwardly toward the adjacent base flap while the base flap of each side wall may be disposed in an overlapping relationship with the adjacent top flap. Further, the engaging flaps may extend inwardly of the carton from their respective base flaps.

In a further preferred embodiment, the tear line or tear lines in the front wall extends from the front edge of the top wall to the lower edge of the front wall whereas the tear line or tear lines in the rear wall extends from the rear edge of the top wall to the lower edge of the rear wall. The number of the tear lines in the front wall may be two so that a second removable portion is defined between such tear lines. The number of the tear lines in the rear wall may also be two so that a third removable portion is defined between such tear lines. The first, second and third removable portions may be joined together to form a single tear away tab that is removable from the carton.

The present invention in another aspect provides a carton which comprises top and base opposed parallel walls, front and rear opposed walls interconnecting the top and base walls to form a tubular structure, opposed side walls at opposite ends of the tubular structure to at least partially close the opposite ends, means for converting the carton from a substantially closed form to an opened display form, and spacers connected respectively to the side walls and extending toward the top wall to engage articles to be accommodated in the carton. The converting means includes a fold line formed in the base wall, and a tear away tab formed at least from the top wall. The fold line extends between the front and rear walls whereas the tear away tab is defined at least by a pair of tear lines each disposed across the top wall.

The spacers may be formed from the side walls. Alternatively, each side wall may comprise top and base flaps hingedly connected to the top and base walls respectively and each spacer may comprise an engaging flap hingedly connected to the respective base flap. The top flap of each side wall may extend downwardly toward the adjacent base wall while the base flap of each side wall may be disposed in an overlapping relationship with the adjacent top flap. The engaging flaps may extend inwardly of the carton from the respective base flaps.

The present invention in a further aspect provides a blank for forming a carton. The blank comprises a top wall panel, a pair of front and rear opposed wall panels hingedly connected to the top wall panel along the front and rear edges of the top wall panel, a base wall panel hingedly connected to one of the front and rear wall panels along the lower edge of the one wall panel that is opposed to the respective one of said front and rear edges, a pair of tear lines each disposed across the top wall panel so that a removable portion is defined between the tear lines, a fold line formed in the base wall and extending from the lower edge of the one wall panel to the free edge of the base wall panel opposed to said lower edge of the one wall panel, a pair of top flaps hingedly connected to the top wall panel along the opposed side edges of the top wall panel respectively, a pair of base flaps hingedly connected to the base wall panel along the opposed side edges of said base wall panel respectively to cooperate with the top flaps to form side walls of the carton, and spacer panels hingedly connected respectively to the base flaps along fold lines substantially parallel to the side edges of the base wall panel.

Other advantages and objects of the present invention will be apparent from the following description, the accompanying drawings, and the appended claims.

DETAILED DESCRIPTION OF THE PREFERRED EMBODIMENTS

Figure 6:
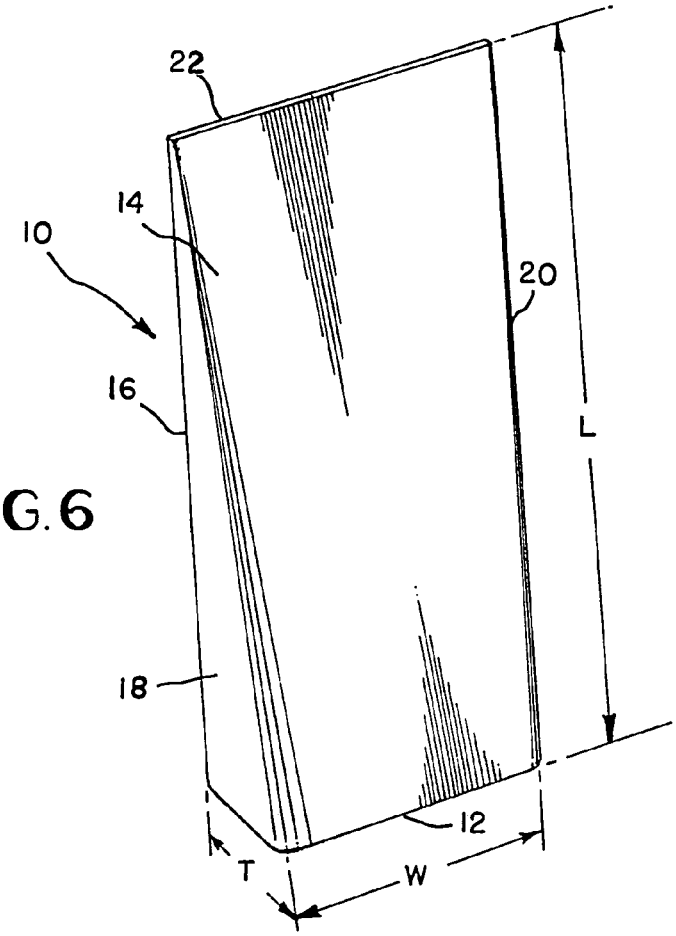
FIG. 6 is a perspective view of one of the tapered articles shown in FIGS. 3 and 4.

FIG. 6 shows a typical tapered article useful in the present invention. The shown article is a stand-up pouch designated at 10, that is filled, for example, with food or drink such as nuts, dried fruits, a pet food treat, a microwavable item, salad croutons, fruit juice or other beverage, or the like. Typically, such a pouch 10 is made of laminated film material. The pouch 10 has a flat generally rectangular bottom 12, front and back generally trapezoidal panels 14 and 16, and opposed generally triangular side panels 18 and 20. The front and back panels 14 and 16 extend upward from the bottom 12 into adjacent contacting and sealed relationship with each other at the top 22 so that they taper to the top. The triangular side panels 18 and 20 have their bases at the bottom 12 and extend upward to their peaks at the top 22. These side panels 18 and 20 interconnect the front and back panels 14 and 16 while forming rounded corners along the junctions between each of the side panels 18 and 20 and the front and back panels 14 and 16. As viewed from the side, the pouch 10 has a generally triangular configuration with the thin top 22 and the thick bottom 12. However, as viewed from the front or back, the bottom 12 is narrower than the top 22. Stated differently, the thickness "T" of the pouch 10 is greater at the bottom 12 than at the top 22 while the width "W" of the pouch 10 is greater at the top 22 than at the bottom 12. In fact, the pouch 10 is similar in configuration to a wedge.

Figure 7:
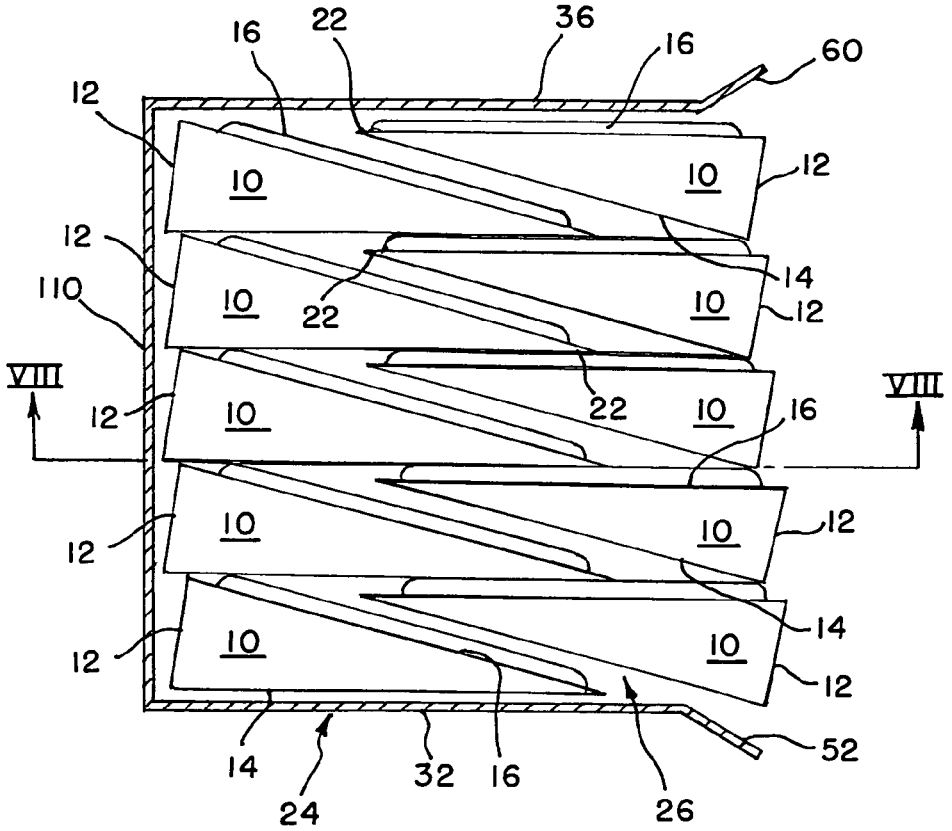
FIG. 7 is a schematic view showing the first loading step in which the articles arranged in two rows are loaded into the carton through an open end.

In accordance with the present invention, such pouches 10 are arranged in two rows 24 and 26 that are oriented in a top-to-top, interleaved or nested relationship, as best shown in FIG. 7. The pouches 10 in each row 24 and 26 are disposed one next to another in a front-to-back opposing relationship while their bottoms 12 face in the same direction. However, the bottoms 12 of the pouches 10 in the first row 24 face opposite to the direction of the bottoms 12 of the pouches 10 in the second row 26. The two-row group of pouches may be assembled such that while the tops 22 of the pouches 10 in the first row 24 are disposed to face the tops 22 of the pouches 10 in the second row 26, the two rows 24 and 26 are moved toward each other to interleave the pouches 10 in the first row 24 with the pouches 10 in the second row 26. Thereafter, the assembled group of pouches 10 is encased in a carton that will be described later.

Figure 1:
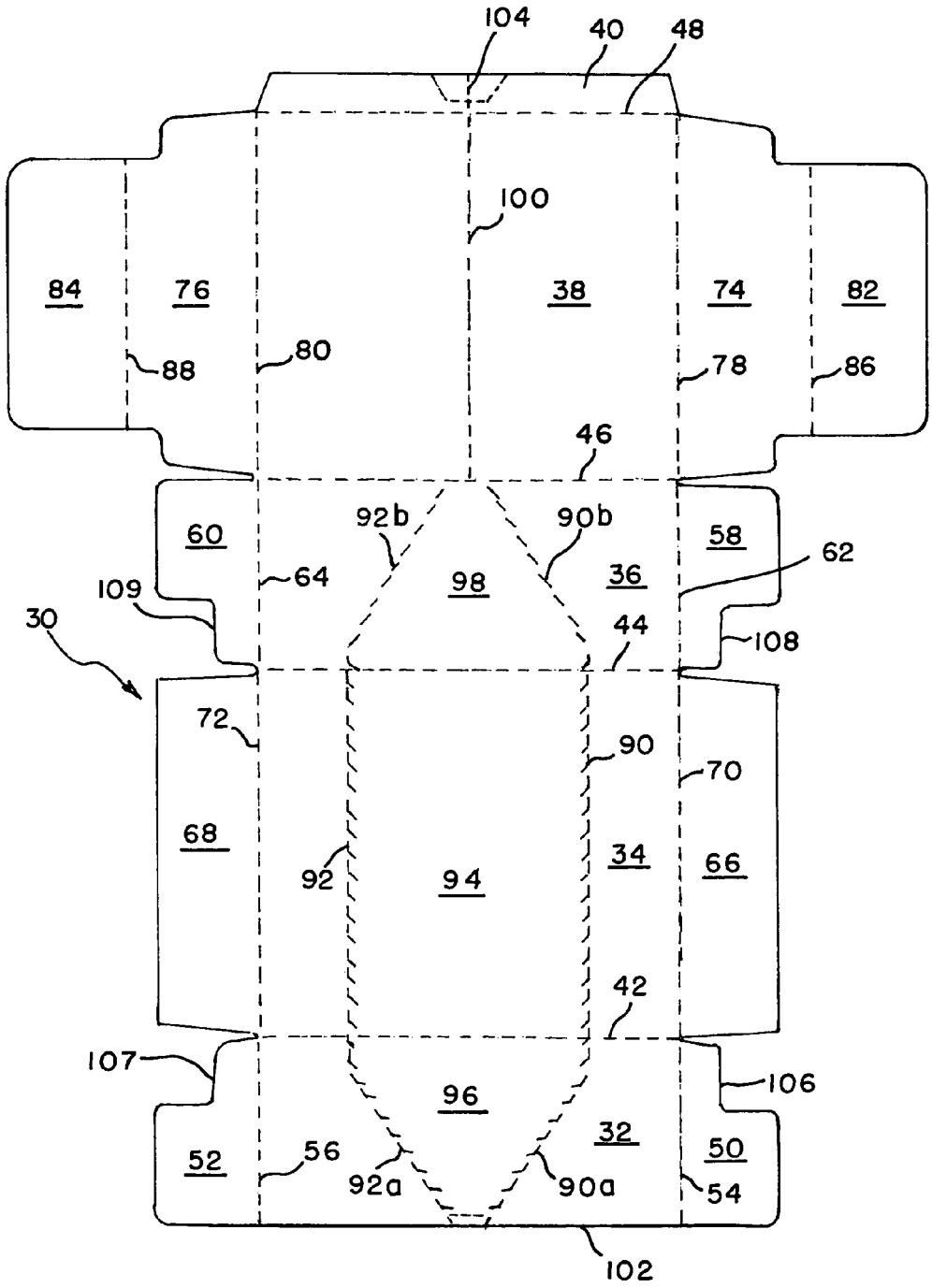
FIG. 1 is a plan view of a blank for forming the carton according to the present invention.

FIG. 1 illustrates a blank 30 for forming the carton for encasing the two-row group of pouches 10. The blank 30 may be formed from any foldable material, such as paperboard, corrugated board or composite sheet material. The blank 30 is preferably die cut from the foldable material. The blank 30 is formed with a rectangular front wall panel 32, a rectangular top wall panel 34, a rectangular rear wall panel 36, a rectangular base wall panel 38 and a securing flap 40 hingedly joined in series along substantially parallel fold lines 42, 44, 46 and 48. A pair of front flaps 50 and 52 are hingedly connected to the front wall panel 32 along fold lines 54 and 56 whereas a pair of rear flaps 58 and 60 are hingedly connected to the rear wall panel 36 along fold lines 62 and 64. A pair of top flaps 66 and 68 are hingedly connected to the top wall panel 34 along fold lines 70 and 72 while a pair of base flaps 74 and 76 are hingedly connected to the base wall panel 38 along fold lines 78 and 80. The fold lines 54, 70, 62 and 78 are aligned to form a continuous line extending along the length of the blank 30 and so do the fold lines 56, 72, 64 and 80. A pair of spacer panels 82 and 84 are hingedly connected to the base flaps 74 and 76 along fold lines 86 and 88 that extend substantially parallel to the fold lines 78 and 80. A center fold line 100 is formed in the base wall panel 38 and extends between the fold lines 46 and 48. The center fold line 100 is disposed parallel to, and mid way between, the fold lines 78 and 80. All the fold lines in the blank 30 may be formed as scored lines, partially cut score lines, perforated lines or other suitable lines in the foldable sheet material.

The blank 30 also includes a plurality of lines of weakening or otherwise tear lines. More specifically, the top wall panel 34 is formed with a pair of tear lines 90 and 92 each extending between the fold lines 42 and 44. The tear lines 90 and 92 define a first removable portion 94 in the top wall panel 34. The fold lines 90 and 92 extend into the front and rear wall panels 32 and 36 to define second and third removable portions 96 and 98 in the front and rear wall panels 32 and 36 respectively. In FIG. 1, the portions 90*a* and 92*a* of the tear lines 90 and 92 in the front wall panel 32 extend convergently from the fold line 42 to the free edge 102 of the front wall panel 32 while the portions 90*b* and 92*b* of the tear lines 90 and 92 in the rear wall panel 36 extend convergently from the fold line 44 to the fold line 46. The portions of the tear lines 90 and 92 within the top wall panel 34 are disposed parallel to each other as well as to the fold lines 70 and 72. The first removable portion 94 is located mid way between the fold lines 70 and 72. The removable portions 94, 96 and 98 as a whole provide a tear away tab that can be removed from the carton when the front, top and rear wall panels 32, 34 and 36 are cut along the tear lines 90 and 92. In addition, the securing flap 40 is also provided with a short tear line 104 that is aligned and collinear with the center fold line 100 of the base wall panel 38. All the tear lines in the blank 30 may be formed as perforated lines, partially cut score lines, half cut lines, lines each composed of a series of slits or other suitable lines in the foldable sheet material.

Figure 2:
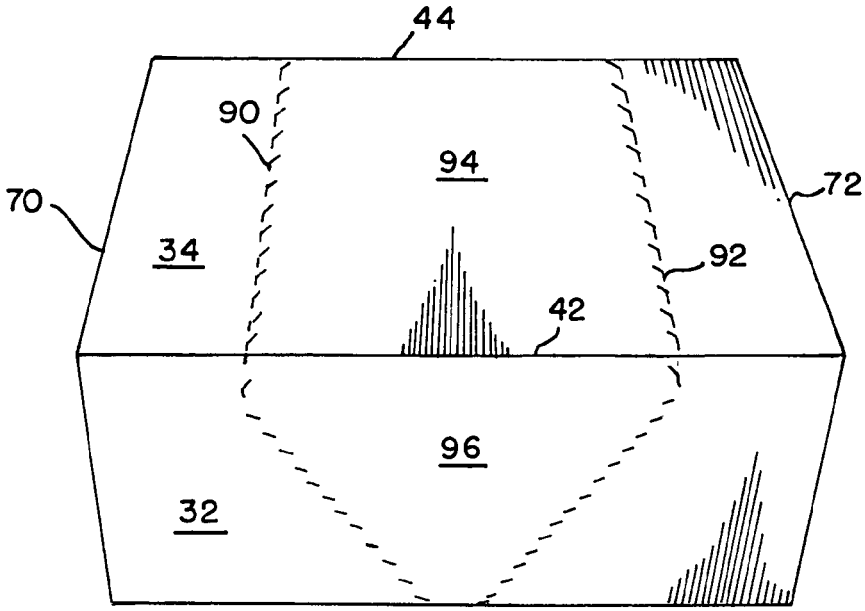
FIG. 2 is a front perspective view of a closed package using a carton formed from the blank of FIG. 1.

FIG. 2 illustrates a package formed by encasing the two-row group of pouches 10 in the carton formed from the blank 30. To form the carton from the blank 30, the base wall panel 38 and its accompanying flaps and panels 40, 74, 76, 82 and 84 are folded about the fold line 46 to lie flat on the rear wall panel 36 and the top wall panel 34. Glue is applied to the securing flap 40, and then the front wall panel 32 and its accompanying flaps 50 and 52 are folded about the fold line 42 to bring the front wall panel 32 into a flat face affixed condition with the securing flap 40. This turns the blank 30 into a flat collapsed tube.

The flat tube formed as described above is then shipped to a bottler who sets the carton up into an erected tubular form and place it with the base wall panel 38 facing down. The flaps 50, 58, 74 and 66 are then folded in the described sequence through approximately ninety (90) degrees each while the top flap 66 is glued to the outside surface of the base flap 74. This results in formation of a side wall 110 (FIGS. 7 and 8) that closes one of the open ends of the tubular carton. After that, the two-row group of pouches 10 is loaded into the tubular carton through the other end of the carton. The loading operation can be performed in a straight line machine so that the carton is not required to be rotated or inverted to provide a loaded package. The loading process is not limited to that described below and can be altered according to particular manufacturing requirements.

Figure 8:
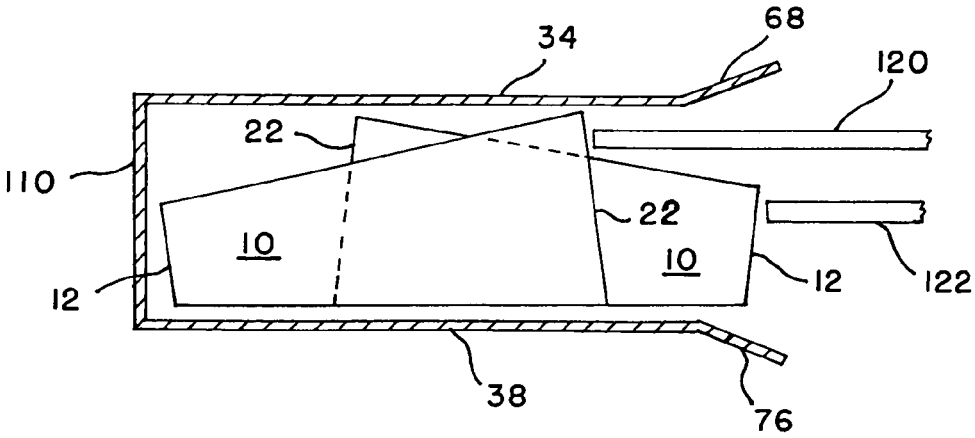
FIG. 8 is a view taken along the line VIII—VIII in FIG. 7.
Figure 9:
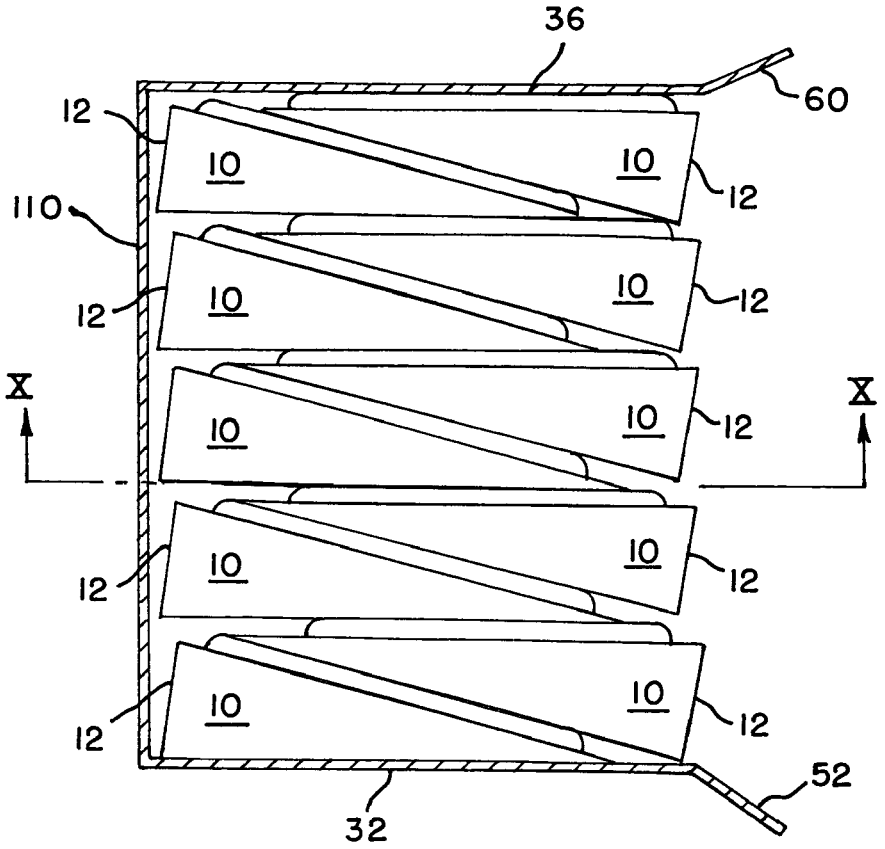
FIG. 9 is a schematic view showing the second loading step in which one of the rows of articles is moved toward the other row to provide a tight package as well as to complete the loading.
Figure 10:
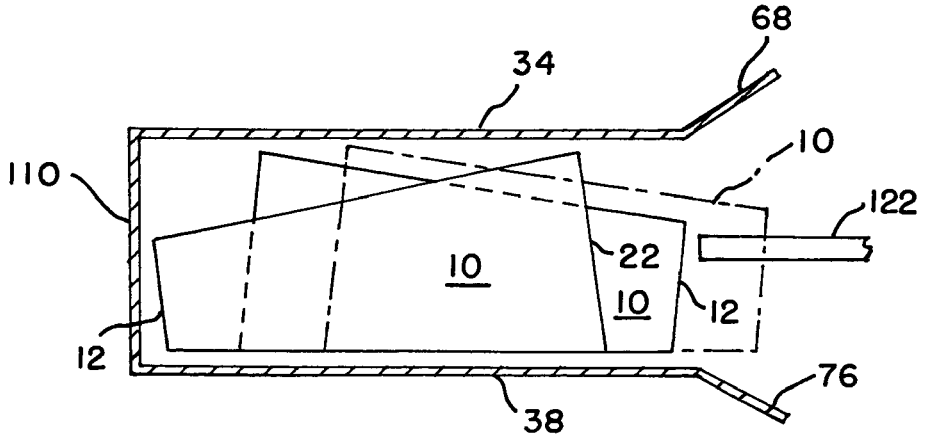
FIG. 10 is a view taken along X—X in FIG. 9.

The loading process may include two steps. At the first step, the two-row group is moved into the carton through the aforesaid other end using two separately operable pushers 120 and 122, i.e., one 120 for moving the first row 24 and the other 122 for the second row 26. This step is best shown in FIG. 8 wherein the pushers 120 and 122 are synchronously operated to move both the first and second rows 24 and 26 simultaneously. During the movement, the two-row group of pouches 10 is so oriented that it is introduced into the carton with the first row 24 first while the pouches 10 in the group lie on their side panels 18 or 20. As a result of this step, the pouches 10 of the first row 24 are fully inserted into the carton with their bottoms 12 facing the side wall 110. However, the pouches 10 in the second row 26 still remain incompletely inserted as shown in FIG. 7. The second step includes moving the pouches 10 in the second row 26 toward the first row 24 using the pusher 122. This is best shown in FIG. 10 wherein the pusher 122 alone is operated independently from the pusher 120. By this means, the pouches 10 in the second row 26 are moved from the position illustrated by the phantom line in FIG. 10 to the position illustrated by the solid line where the pouches of the second row 26 are completely accommodated in the carton. As a result of this step, the pouches 10 in the second row 26 are even more deeply nested in the pouches 10 in the first row 24 as shown in FIG. 9 so that the two-row group of pouches 10 occupies an yet smaller volume and thereby provides a tighter package.

Figure 3:
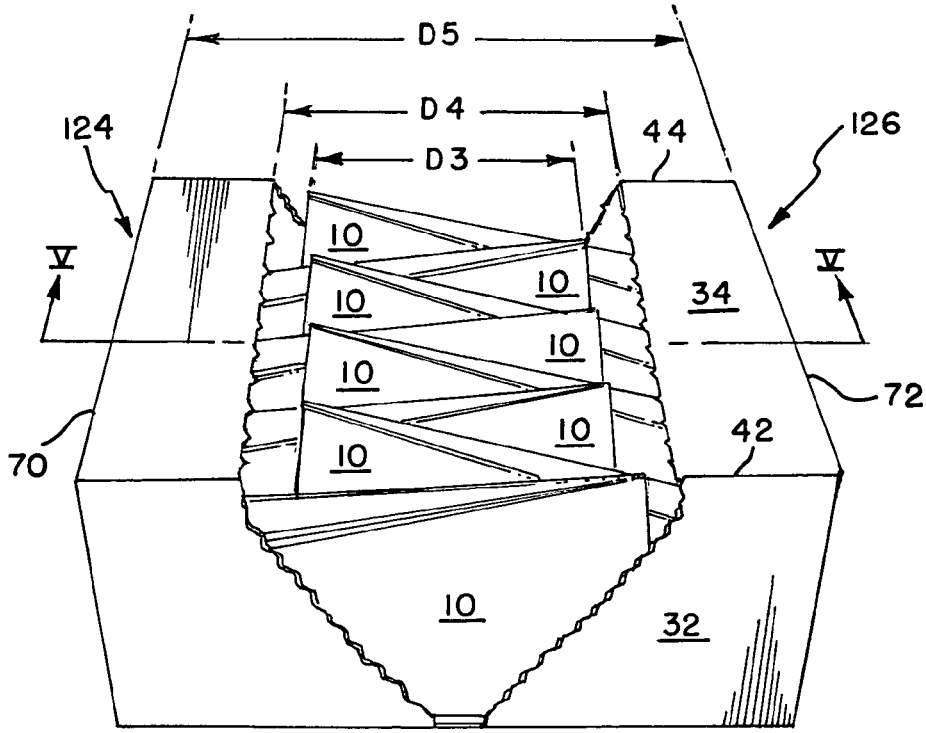
FIG. 3 is a front perspective view of the package of FIG. 2 with a tear away tab completely removed from the carton, showing a two-row group of tapered articles contained in the carton.
Figure 5:
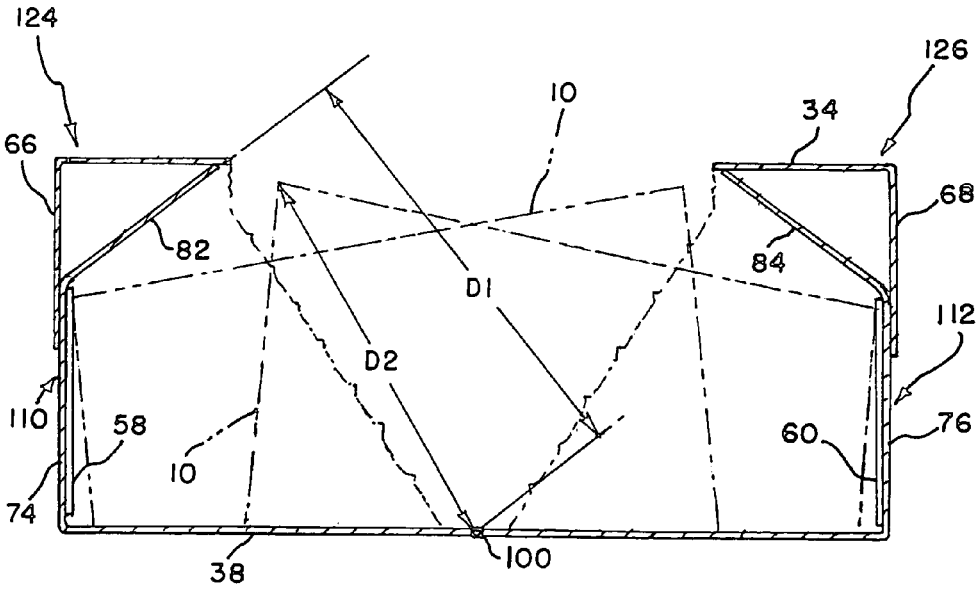
FIG. 5 is a view taken along the line V—V in FIG. 3, showing the packaged articles in the phantom lines.

After the second step, the other end of the carton is closed by the other side wall 112 (FIG. 5) that is formed by folding and gluing of the flaps 52, 60, 68 and 76 in a similar manner to that in which the side wall 110 was formed. In the completed package in FIG. 2, the bottoms 12 of the pouches 10 in the second row 26 face the inside surface of the side wall 112 while the first and second rows 24 and 26 are disposed along the fold lines 70 and 72 respectively, which is suggested in FIG. 3. The spacer panels 82 and 84, as shown in FIG. 5, extend from the respective base flaps 74 and 76 toward the top wall 34 so that each space panel 82 and 84 is located between the top wall 34 and the bottoms 12 of the pouches 10 in the respective row. Such a disposition of the spacer panels 82 and 84 is available due to the respective cutouts 106, 108; and 107, 109 (FIG. 1) in the front and rear flaps 50, 58; and 52, 60 that allow the spacer panels 82 and 84 to extend therethrough.

Figure 4:
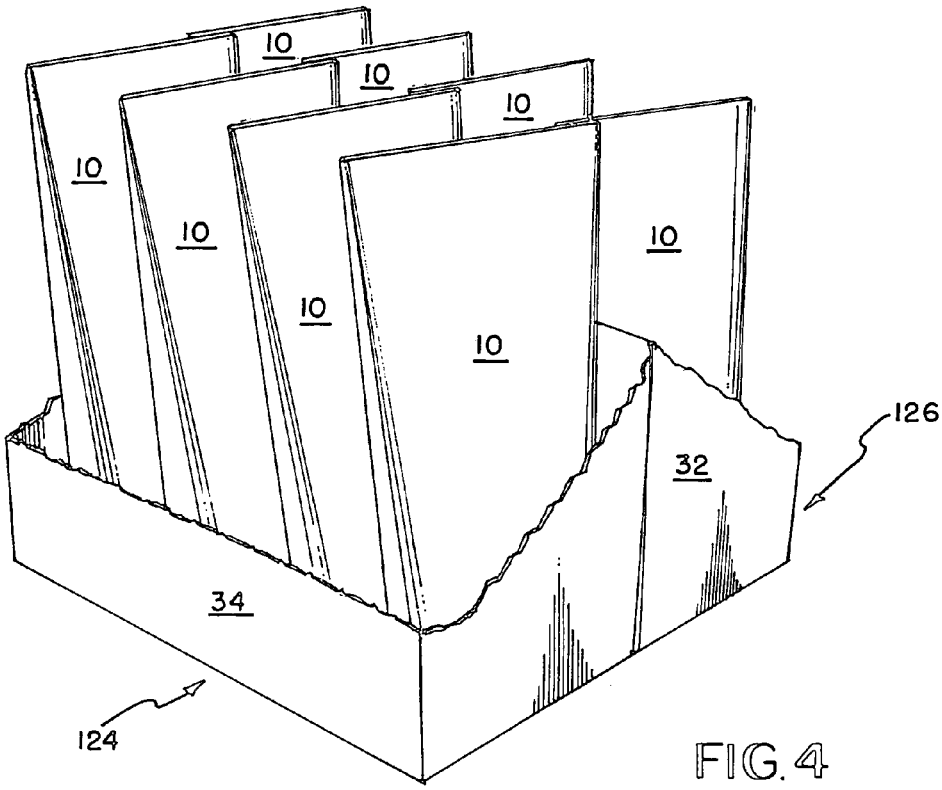
FIG. 4 is a perspective view of the package of FIG. 3 in an opened display form showing two connected display trays arranged side by side with the two rows of articles displayed thereon.

The package in the closed form of FIG. 2 can be converted or transformed into an opened display form through a few simple steps. First, the second removable portion 96 is torn along tear line portions 90*a* and 92*a* and pulled upwards. Such upward force severs the first removable portion 94 from the top wall 34 along the tear lines 90 and 92. The severed portion 94 is then pulled rearward, which severs the third removable portion 98 from the rear wall 36 along the tear line portions 90*b* and 92*b*. This removes the entire tear away tab from the carton, providing the right and left two carton sections 124 and 126 as viewed in FIG. 3 that are divided by the opening through which the packaged pouches 10 are exposed. The two sections 124 and 126 of the carton are then pivoted or rotated downwardly about the fold line 100 in the base wall 38 in the manner that the base wall 38 is folded double to bring the two halves of the base wall 38 into a face-contacting relationship. During the pivotal movement, the pouches 10 in the two rows 24 and 26 are also pivoted together with the respective two sections 124 and 126 and are thereby automatically and efficiently uninterleaved or separated from each other. This provides a display device shown in FIG. 4 that is formed of a pair of display trays (i.e., the carton sections 124 and 126) arranged side by side with the pouches 10 of the two rows 24 and 26 displayed thereon respectively. On each tray, the pouches 10 are already arranged in a pre-aligned, stand-up condition with their front panels 14 facing forward for display to retail customers without requiring physical rearrangement. The display trays 124 and 126 are connected along the fold line 100 and therefore is not subject to an undesired displacement from each other.

The separation of the two rows 24 and 26 during the pivotal movement of the carton sections 124 and 126 is facilitated by the following two structural features of the package. First, the pouches 10 in the two rows 24 and 26 are substantially gripped at their bottoms 12 by the respective carton sections 124 and 126 between the base wall 38 and the respective spacer panels 82 and 84. In other words, the spacer panels 82 and 84 prevent the pouches 10 from playing within the respective carton sections 124 and 126 and thereby enable the pouches 10 to pivot in quick response to the pivotal or rotational movement of the carton sections 124 and 126. Second, "D1" in FIG. 5 is greater than "D2" in the same drawing where "D1" stands for the distance between the fold line 100 and either tear line 90 or 92 in the top wall 34, and "D2" stands for the maximum distance between the fold line 100 and the tops 22 of the pouches 10 in either row 24 or 26. This feature prevents interference of either carton section 124 or 126 with the pouches 10 in the other carton section during the rotational movement of the carton sections 124 and 126. If the distance "D1" were less than the distance "D2", the top wall 34 of the carton section 124 would interfere with the pouches 10 in the second row 26 whereas the top wall 34 of the carton section 126 would interfere with the pouches 10 in the first row 24. The above second structural condition may be simulated by setting "D3" in FIG. 3 less than "D4" in the same drawing where "D3" is the distance between the tops of the respective pouches 10 of the two rows 24 and 26, and "D4" is the distance between the parallel tear lines 90 and 92 in the top wall 34. Such a simulated condition may, in turn, be generally represented by the following formula:

$$D4>2\times L-D5$$

where "L" is the length of a pouch 10 and "D5" is the width of the carton. In fact, the distance "D3" is nearly equal to "2×L−D5" (see FIGS. 3 and 6).

Figure 12:
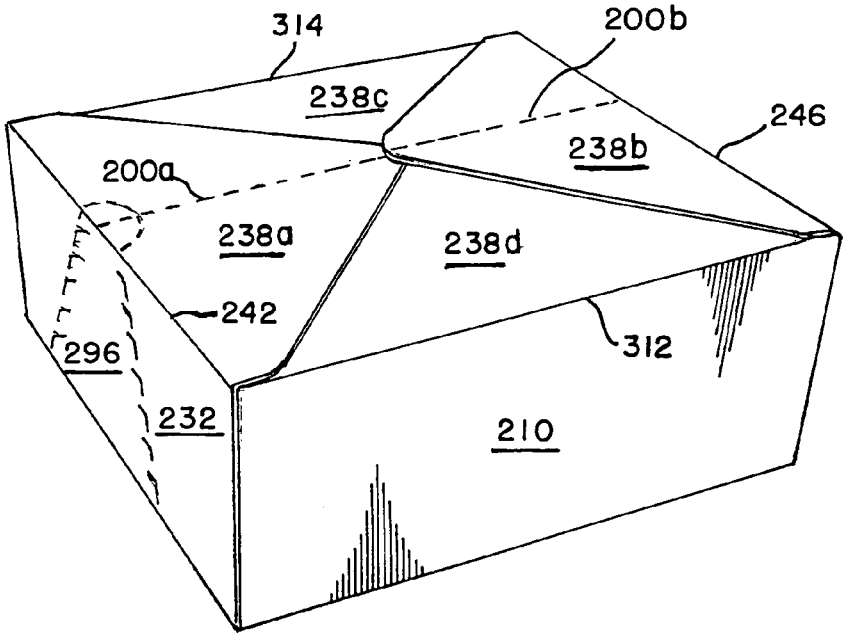
FIG. 12 is a bottom perspective view of a closed package using the carton formed from the blank of FIG. 11.
Figure 11:
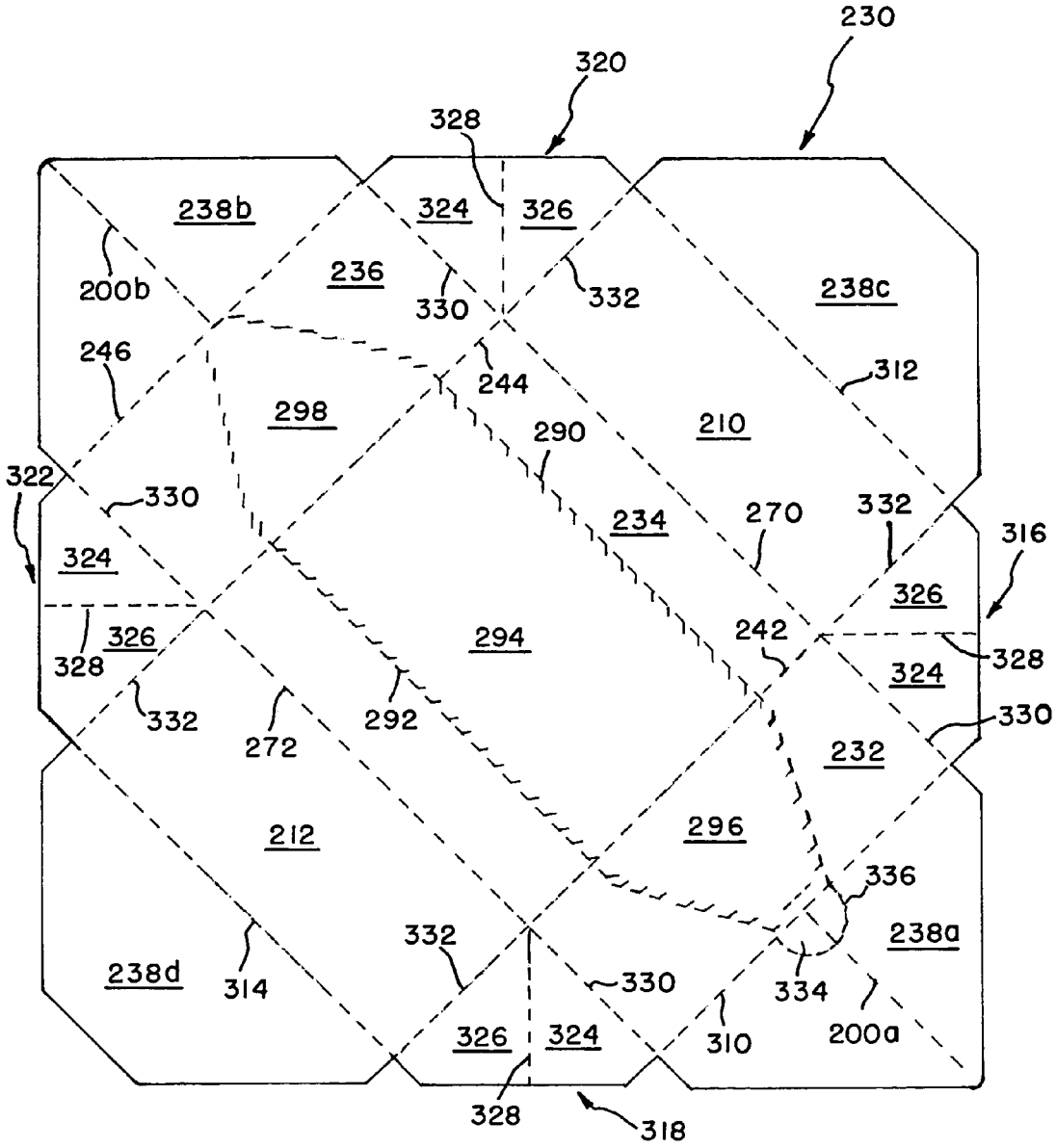
FIG. 11 is a plan view of a blank for forming a carton according to a second embodiment of the invention.

FIG. 11 illustrates a blank for forming a carton of the second embodiment according to the present invention while FIG. 12 illustrates a package formed from the blank of FIG. 11 and the aforementioned two-row group of pouches. In these drawings, like parts have been designated by the same reference numeral with the prefix "2" and only the differences are discussed in any greater detail in the following description.

Referring to FIG. 11, the blank 230 as a whole is generally rectangular in shape. A rectangular front wall panel 234 is centrally located in the blank 230 and flanked by a pair of opposed side wall panels 210 and 212 along fold lines 270 and 272. Base wall panel portions 238*a*, 238*b*, 238*c* and 238*d* are hingedly connected to the front, rear and side wall panels 232, 236, 210 and 212 along fold lines 310, 246, 312 and 314 respectively. These panel portions 238*a*, 238*b*, 238*c* and 238*d* cooperate together to form a base wall when the blank 230 is erected into a carton as shown in FIG. 12. The base wall panels portions 238*a* and 238*b* are formed respectively with fold lines 200*a* and 200*b* for providing a center fold line in the base wall. The fold line 200*a* extends from the fold line 310 to the outer free edge of the base wall panel portion 238*a* while the fold line 200*b* extends from the fold line 246 to the outer free edge of the base wall panel portion 238*b*. As shown in FIG. 12, the center fold line 200*a* and 200*b* in a set-up carton is disposed parallel to, and mid way between, the fold lines 312 and 314.

Returning to FIG. 11, each of the front and rear wall panels 232 and 236 and either side wall panel 210 and 212 are interconnected by a web structure 316, 318, 320 and 322. Each web structure includes a pair of gusset panels 324 and 326 hingedly connected together along a medial fold line 238. The gusset panel 324 of each web structure is hingedly connected to the respective one of front and rear wall panels 232 and 236 along a fold line 330 whereas the gusset panel 326 of each web structure is hingedly connected to the respective side wall panel 210 or 212 along a fold line 332. In addition, a push tab 334 is defined by an arched tear line 336 in the base wall panel portion 238*a* so as to facilitate tearing of the second removable portion 296 along the tear lines 290 and 292.

The way the package of FIG. 12 is formed is substantially different from the way in which the package of the first embodiment is formed particularly in that the blank 230 is designed to be delivered to a packager (e.g., a bottler) in its intact blank form so that the entire package-forming process is carried out by the packager.

To form the package of FIG. 12, the two-row group of pouches is placed on the top wall panel 234 with the pouches' side panels facing down and the two rows of pouches being disposed along the fold lines 270 and 272 respectively. Then, the front wall panel 232, the base wall panel portion 238*a* and the web structures 316 and 318 are folded about the fold line 242 to take an upright position alongside the endmost pouches in the first and second rows. Simultaneously, the rear wall panel 236, the base wall panel portion 238*b* and the web structures 320 and 322 are folded about the fold line 244 to take an upright position alongside the other endmost pouches in the first and second rows. Subsequently, the side wall panel 210 and the base wall panel portion 238*c* are folded about the fold line 270 to take an upright position alongside the bottoms of the pouches in the first row while the web structures 316 and 320 are folded about the respective fold lines 328, 330 and 332 to be tucked between the side wall panel 210 and the first row of pouches. The side wall panel 212 and the base wall panel portion 238*d* are folded about the fold line 272 simultaneously with, or subsequently to, the folding of the side wall panel 210 so that it takes an upright position alongside the bottoms of the pouches in the second row. The web structures 318 and 322 are tucked between the side wall panel 212 and the second row of pouches in a similar manner to the web structures 316 and 320. The pouches in the first row may be moved toward those in the second row, or vice versa, simultaneously with, or prior to, the folding of the side wall panels 210 and 212. Such movement of either or both of the rows allows the pouches in the rows to be nested deeply to provide a tight package.

Finally, the base wall panel portions 238*c* and 238*d* are folded about the fold lines 312 and 314 to lie on the rows of pouches, and then the base wall panel portions 238*a* and 238*b* are folded about the fold lines 310 and 246 to lie flat on the base wall panel portions 238*c* and 238*d*. Glue is applied to appropriate areas before the folding of the panel portions 238*a* and 238*b* to secure the panel portions 238*a* and 238*b* together and/or to the panels portions 238*c* and 238*d*.

The package of FIG. 12 can be converted into a pair of connected display trays in the manner substantially identical to that in which the first embodiment is converted. In particular, the separation of the two rows of pouches is facilitated by the arrangement wherein the distance between the center fold line 200*a* and 200*b* and either tear line 290 or 292 in the top wall 234 is greater than a maximum distance between the center fold line 200*a* and 200*b* and the bottoms of the pouches in either row.

While the present invention has been described with preferred embodiments, it should be understood that variations and modifications may be resorted to as will be apparent to those skilled in the art. Such variations and modifications are to be considered within the purview and the scope of the claims appended hereto.

It should be readily apparent that although tear lines 90, 92; and 290, 292 are preferably parallel to each other, it is within the scope of the present invention to also have non-parallel tear lines defining the removable portions 94 and 294. When tear lines 90 and 92 are not parallel to each other, for example, "D1" should stand for a minimum distance between the center fold line 100 and either tear line 90 or 92.

Figure 13:
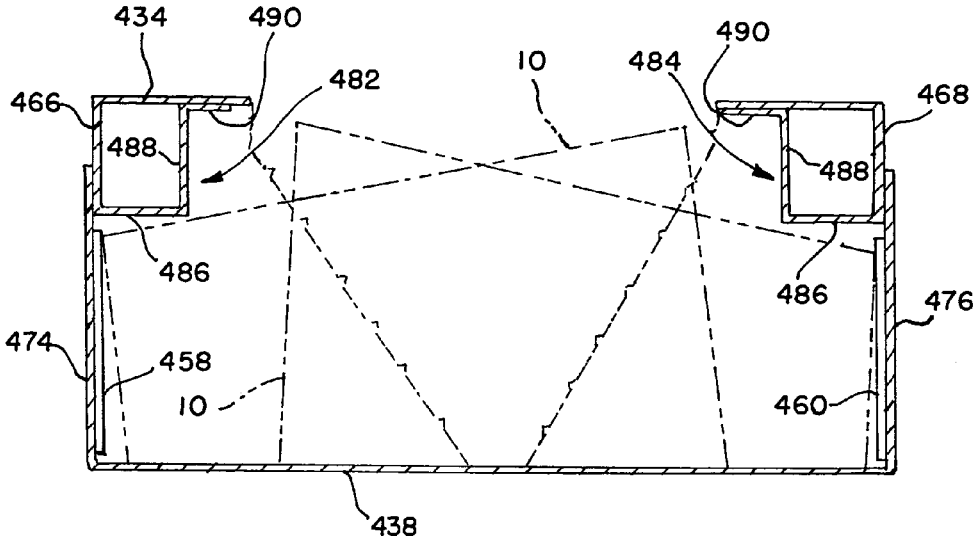
FIG. 13 is a schematic view showing a modified form of the spacer in FIG. 5.
Figure 14:
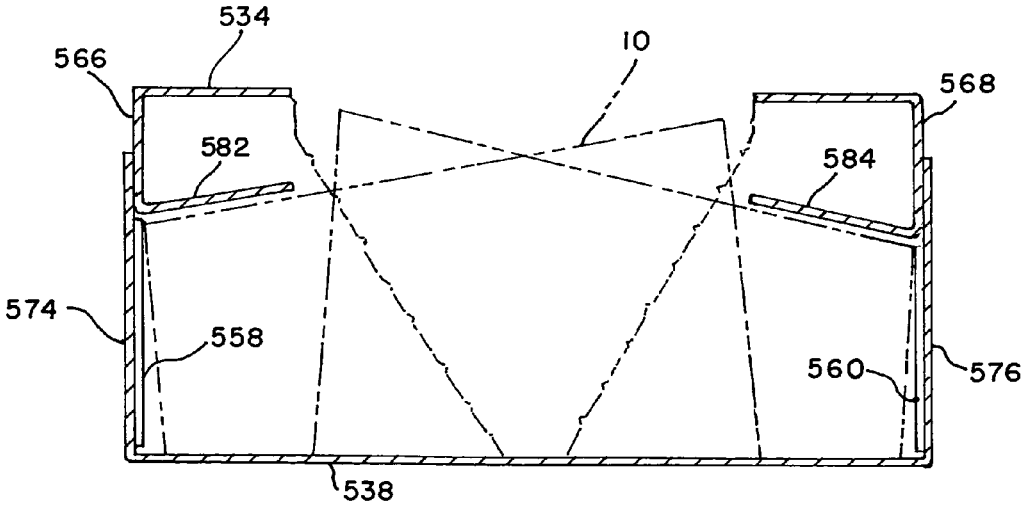
FIG. 14 is a schematic view showing another modified form of the spacer in FIG. 5.

It should be also apparent that that the spacers useful in the present invention are not limited to the spacer panels hinged to the base flaps but include spacers hingedly connected to the top flaps. An example of such spacers (i.e., a modified form of the spacers in FIG. 5) are shown in FIG. 13 wherein each spacer 482 and 484 is formed of a series of three hinged panels 486, 488 and 490 for providing a tubular element positioned between the carton top wall 434 and respective row of pouches 10. The panel 486 is hingedly connected to the lower edge of the respective top flap 466 or 468 while the panel 490 is glued to the inside surface of the top wall 434. The cross section of each tubular spacer 482 and 484 is either rectangular or square so that the spacers are collapsible into a flat form. The gluing of the panels 490 is carried out by a carton manufacturer, and the carton in a flat form is shipped to a packager, such as a bottler, with the spacers 482 and 484 in a flat collapsed condition. During the carton-loading process by the packager, the spacers 482 and 484 may be automatically erected in response to downward folding of the top flaps 466 and 468. The base flaps 474 and 476 are secured to the outside surfaces of the top flaps 466 and 468 respectively to close the opposite ends of the carton. Alternatively, the front and rear flaps (only the rear flaps 458 and 460 are shown in FIG. 13) may be disposed externally of the top and base flaps 466, 468; and 474, 476 to be secured to the outside surfaces of the top and base flaps. In this variation, the tubular spacers 482 and 484 may be extended entirely between the front and rear walls to increase the stacking strength of the carton. A further example of the spacers are shown in FIG. 14 wherein each spacer is formed of a spacer panel 582 or 584 hingedly connected to the lower edge of the respective top flap 566 or 568. The spacer panels 582 and 584 are folded inwardly of the carton with respect to the top flaps 566 and 568 to be disposed along the side panels 18 or 20 of the pouches 10 in the respective rows. The base flaps 574 and 576 are secured to the outside surfaces of the top flaps 566 and 568.

It should be further appreciated that the tear away tab useful in the present invention is not limited to those formed of the three removable portions. For example, each of the second and third removable portions in the front and rear walls may be replaced by a single tear line extending vertically across the respective wall.

It should be still further appreciated that the tapered articles useful in the present invention are not limited to the flexible pouches but include any other tapered product such as plastic tumblers, plastic bottles, yarn spools or the like.

It should be still further appreciated that as used herein, directional references such as "top", "base", "end", "side", "front", "rear", "back", "upper" and "lower" do not limit the respective panels and/or walls to such orientation, but merely serve to distinguish these panels and/or walls from one another. The orientation of the package could be altered depending on, for example, the articles to be carried in the carton. Simple modifications could result in, for example, the front wall being located on the top or side of the package.

It should be still further appreciated that any reference to fold line should not be construed as necessarily referring to a single fold line. Indeed, it is envisaged that a fold line can be replaced by a hinged connection formed from one or more of one of the following, a score line, a half cut line or a perforated line, without departing from the scope of invention.

What is claimed is:

1. A package comprising:

a carton including a top wall having front and rear edges and a pair of opposed side edges, front and rear walls extending downwardly respectively from said front and rear edges of said top wall to respective lower edges thereof, a base wall extending between said lower edges of said front and rear walls, and a pair of opposed side walls extending downwardly from said side edges of said top wall to said base wall; and a plurality of tapered articles disposed within said carton, each of said articles having top and bottom, said top being less in thickness than said bottom, said articles being arranged into a group of two rows disposed respectively along said side edges of said top wall with said bottoms of said articles in one of said rows facing one of said side walls of said carton and said bottoms of said articles in the other row facing the other side wall of said carton, said tops of said articles in said one row being disposed in an overlapping nested relationship with said tops of said articles in said other row, wherein said top wall of said carton is formed with a pair of parallel tear lines extending from said front edge to said rear edge to define therebetween a first removable portion, said base wall being formed with a fold line disposed substantially parallel to said parallel tear lines and extending between said lower edges of said front and rear walls, said fold line being located at a first distance from either one of said parallel tear lines, each of said front and rear walls being formed with at least one tear line so that said carton is separable into two display trays with said side walls forming bottoms of said display tray when said removable portion is removed from said carton and said base wall is folded double along said fold line, and wherein said first distance is greater than a maximum distance between the fold line and said tops of said articles in either one of said two rows.

2. The package according to claim 1 wherein said removable portion is disposed mid way between said opposed side edges of said top wall, said tops of said articles in said one row are disposed at a second distance along said front edge from said tops of said articles in said other row, said second distance is less than the distance between said parallel tear lines in said top wall.

3. The package according to claim 1 wherein said fold line in said base wall extends generally along said thickness of said articles of said group and generally perpendicularly to the length of said articles of said group, said top of said each article is greater in width than said bottom thereof, said top and base walls are spaced at a distance generally equal to said width of said each article at said top, and said carton further comprises a spacer disposed between said top wall and said bottoms of said articles in each of said rows.

4. The package according to claim 3 wherein said spacers are formed from said side walls of said carton.

5. The package according to claim 4 wherein each of said side walls comprises a top flap hingedly connected to said top wall and a base flap hingedly connected to said base wall, and each of said spacers comprises an engaging flap hingedly connected to said base flap of an adjacent one of said side walls.

6. The package according to claim 5 wherein said top flap of said each side wall extends downwardly toward said base flap of said each side wall, said base flap of said each side wall is disposed in an overlapping relationship with said top flap of said each side wall, and said engaging flaps extend inwardly of said carton from said base flaps.

7. The package according to claim 4 wherein each of said side walls comprises a top flap hingedly connected to said top wall and a base flap hingedly connected to said base wall, and each of said spacers comprises at least one panel hingedly connected to said top flap of an adjacent one of said side walls.

8. The package according to claim 7 wherein said at least one panel is extended entirely between said front and rear walls to increase the stacking strength of said carton.

9. The package according to claim 1 wherein said at least one tear line in said front wall extends from said front edge of said top wall to said lower edge of said front wall, and said at least one tear line in said rear wall extends from said rear edge of said top wall to said lower edge of said rear wall.

10. The package according to claim 9 wherein said at least one tear line in said front wall comprises a pair of tear lines which define therebetween a second removable portion, and said at least one tear line in said rear wall comprises a pair of tear lines which define therebetween a third removable portion.

11. The package according to claim 10 wherein said first, second and third removable portions are joined together to form a single tear away tab removable from said carton.

12. A carton comprising:

a pair of top and base opposed walls in a spaced parallel relationship;

a pair of front and rear opposed walls interconnecting said top and base walls to form a tubular structure;

a pair of opposed side walls disposed at opposite ends of said tubular structure to at least partially close said opposite ends;

means for converting the carton from a substantially closed form to an opened display form, said converting means including a fold line formed in said base wall, and a tear away tab formed at least from said top wall, said fold line extending between said front and rear walls, said tear away tab being defined at least by a pair of tear lines each disposed across said top wall; and a pair of spacers connected respectively to said side walls and extending toward said top wall to engage articles to be accommodated in said carton.

13. The carton according to claim 12 wherein said spacers are formed from said side walls.

14. The carton according to claim 13 wherein each of said side walls comprises a top flap hingedly connected to said top wall and a base flap hingedly connected to said base wall, and each of said spacers comprises an engaging flap hingedly connected to said base flap of an adjacent one of said side wall.

15. The carton according to claim 14 wherein said top flap of said each side wall extends downwardly toward said base wall of said each side wall, said base flap of said each side wall is disposed in an overlapping relationship with said top flap of said each side wall, and said engaging flaps extend inwardly of said carton from said base flaps.

16. The carton according to claim 13 wherein each of said side walls comprises a top flap hingedly connected to said top wall and a base flap hingedly connected to said base wall, and each of said spacers comprises at least one panel hingedly connected to said top flap of an adjacent one of said side walls.

17. The carton according to claim 16 wherein said at least one panel is extended entirely between said front and rear walls to increase the stacking strength of the carton.

18. A blank for forming a carton, said blank comprising:

a top wall panel having a pair of front and rear opposed edges and a pair of opposed side edges;

a pair of front and rear opposed wall panels hingedly connected to said top wall panel along said front and rear edges respectively;

a base wall panel hingedly connected to one of said front and rear wall panels along a lower edge of said one wall panel opposed to a respective one of said front and rear edges;

a pair of tear lines each disposed across said top wall panel so that a removable portion is defined between said tear lines;

a fold line formed in said base wall and extending from said lower edge of said one wall panel to a free edge of said base wall panel opposed to said lower edge, a pair of top flaps hingedly connected to said top wall panel along said side edges of said top wall panel respectively;

a pair of base flaps hingedly connected to said base wall panel along opposed side edges of said base wall panel respectively to cooperate with said top flaps to form side walls of the carton; and spacer panels hingedly connected respectively to said base flaps along fold lines substantially parallel to said side edges of said base wall panel.

19. A method of forming a package by loading tapered articles into a tubular carton, each of said articles having top and bottom, said top being less in thickness than said bottom, said method comprising the steps of:

arranging said articles into a group of two rows including first and second rows wherein said bottoms of said articles in said first row face away from said bottoms of said articles in said second row and wherein said tops of said first row articles are disposed in an overlapping nested relationship with said tops of said second row articles;

moving said first and second row articles simultaneously into said carton through one end of said carton while said group is oriented such that said first row articles are moved first into the carton, and thereby inserting said first row articles fully into said carton while said second row articles remain incompletely inserted into said carton;

moving said second row articles toward said first row articles so that said second row articles are more deeply nested in said first row article, and thereby inserting said second row articles completely into said carton; and closing said one end of said carton by a suitable end closure wall.

20. The packaging method according to claim 19 wherein said moving steps are carried out by two separately operable pushers, one of said pushers being used for moving said first row articles and the other pusher for said second row articles.

21. The packaging method according to claim 20 wherein said first moving step comprises operating said two pushers synchronously to move both said first and second row articles simultaneously, and said second moving step comprises operating said other pusher independently from said one pusher to move only said second row articles.

* * * * *